United States Patent [19]

Nelson

[11] 4,229,780

[45] Oct. 21, 1980

[54] FLUORESCENT LAMP FOR USE IN EXPLOSIVE ATMOSPHERES SUCH AS MINES

[75] Inventor: Robert C. Nelson, Bluefield, W. Va.

[73] Assignee: West Virginia Armature Company, Glen Lyn, Va.

[21] Appl. No.: 919,662

[22] Filed: Jun. 27, 1978

[51] Int. Cl.[2] ..... H05B 33/02

[52] U.S. Cl. ..... 362/218; 362/222; 362/376

[58] Field of Search ..... 362/185, 217, 218, 221, 362/222, 223, 224, 260, 376; 339/52 R, 52 S

[56] References Cited

U.S. PATENT DOCUMENTS

| | | | |
|---|---|---|---|
| 2,347,174 | 4/1944 | Cross et al. | 362/222 |
| 2,472,180 | 6/1949 | Tittle | 362/222 |
| 2,760,053 | 8/1956 | Choisser | 339/52 R |
| 2,798,149 | 7/1957 | Bodez | 362/222 |
| 2,874,270 | 2/1959 | Douglass et al. | 362/222 |
| 3,564,234 | 2/1971 | Phlieger | 362/222 |
| 3,833,801 | 9/1974 | Trevithick | 362/222 |
| 4,042,819 | 8/1977 | Dacal | 362/222 |
| 4,070,570 | 1/1978 | Wetmore | 362/218 |
| 4,156,893 | 5/1979 | Baake | 362/376 |

*Primary Examiner*—L. T. Hix
*Assistant Examiner*—Alan Mathews
*Attorney, Agent, or Firm*—McCaleb, Lucas & Brugman

[57] ABSTRACT

Lamp having an elongated lighting assembly and a guard assembly therefor. The lighting assembly includes an elongated fluorescent bulb characterized by hot regions at the end portions of its luminous envelope. The guard assembly includes: a tubular light-transmitting housing of polycarbonate or glass; metal end housings; and closure members closing the open outer ends of the end housings. Heat conductive metal bushings are cemented to the end portions of the light-transmitting housing. These have cylindrical bearing surfaces telescopically assembled in contiguous, lapping, heat-conductive relationship with corresponding bearing surfaces on the end housings. The metal bushings function as heat sinks and heat conductors, cooling the portions of the light-transmitting housing which are subject to radiation from the hot regions of the bulb by conducting heat through the bushings into the metal end housings which dissipate it to the surroundings. The light-transmitting housing is free to expand and contract and turn about the lighting assembly. The end housings are optionally interconnected by a guard cage overlying the light-transmitting housing, or by an external tie bar. The lighting assembly has an electrical plug engaging the socket portion of a socket and terminal cartridge assembly connected to the inside of the head end closure member which is removable to facilitate wiring and internal servicing separately from the rest of the lamp assembly. The socket and terminal cartridge assembly may include a circuit such as a ballast or starter, or both, located in a recess in the head end housing and removable as a unit with the head end closure member.

6 Claims, 12 Drawing Figures

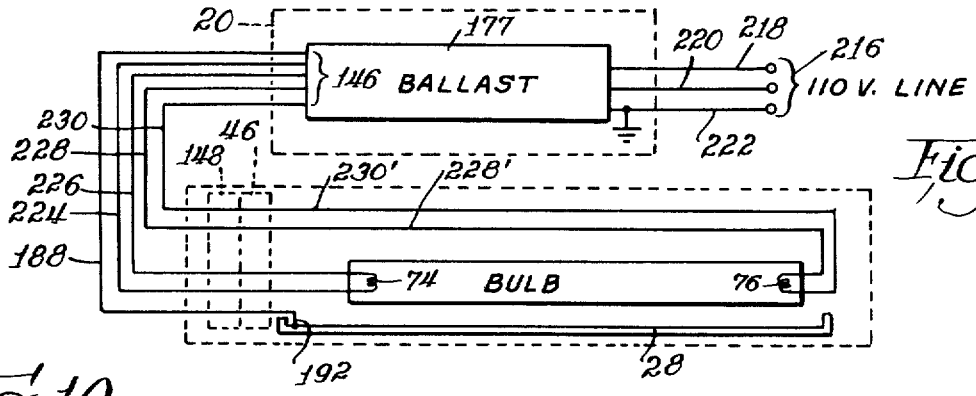
Fig. 9.
Fig. 10.
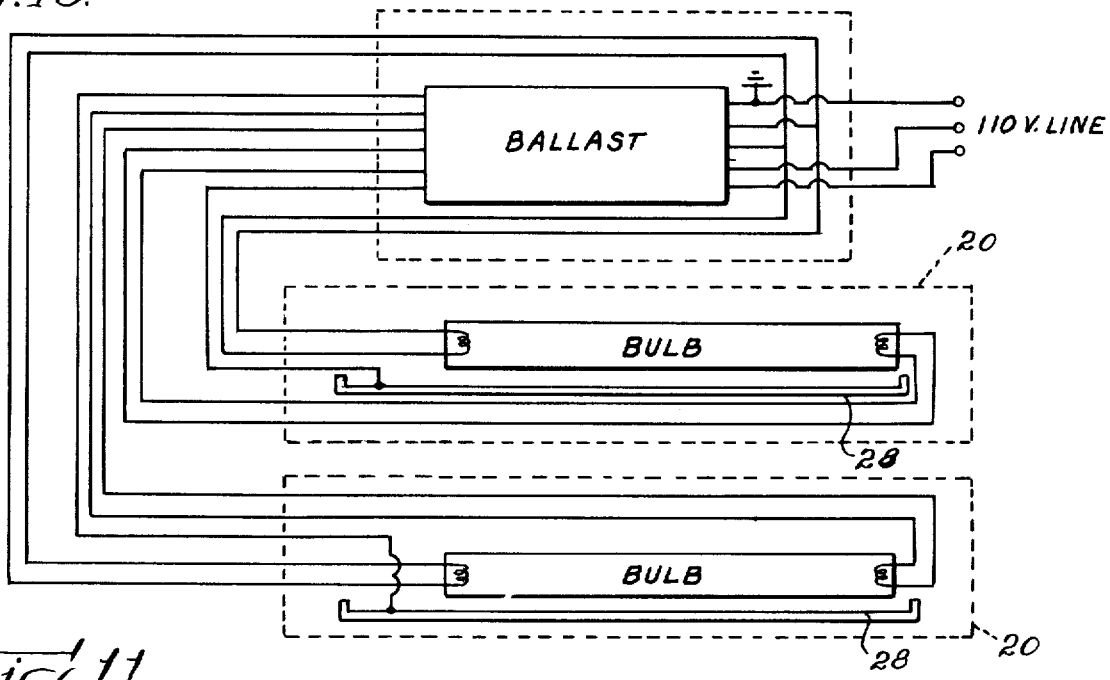
Fig. 11.
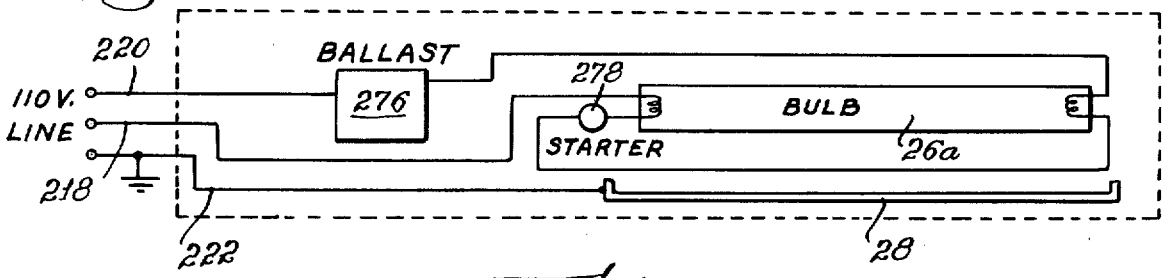
Fig. 12.
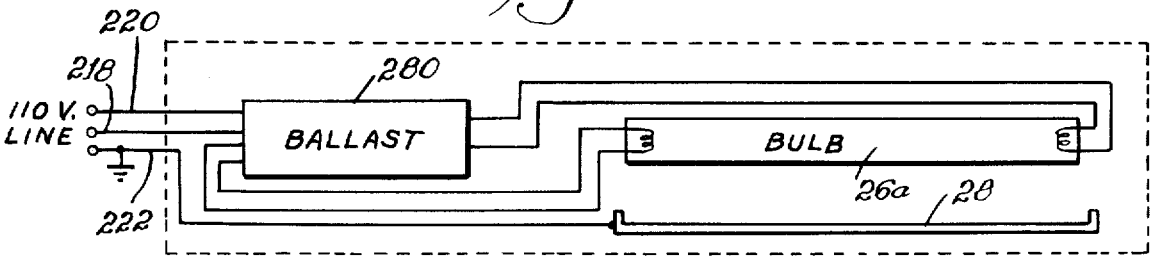

FLUORESCENT LAMP FOR USE IN EXPLOSIVE ATMOSPHERES SUCH AS MINES

CROSS REFERENCE TO RELATED APPLICATION AND PATENTS

Reference is made to the following related patents:

Decal U.S. Pat. No. 4,042,819 issued Aug. 16, 1977;

Decal U.S. Pat. No. D244,501 issued May 31, 1977; and

Decal U.S. Pat. No. D244,794 issued June 21, 1977; each entitled FLUORESCENT LAMP FOR USE IN EXPLOSIVE ATMOSPHERES SUCH AS MINES.

BACKGROUND OF THE INVENTION

This invention pertains to the field of electrical illuminating apparatus and particularly to such apparatus which is permissible under Mine Safety and Health Administration (MSHA) standards and regulations promulgated under the Federal Mine Safety and Health Act for use in explosive atmospheres such as coal mines.

Lighting in mines has always been relatively poor compared to working environments aboveground where minimum illumination standards for various tasks have long been established.

The difficulty of providing adequate lighting in coal mines is aggravated by the low reflectivity of the black coal and associated minerals in the roof, floor, and ribs. Rock-dusting, where employed, does provide a reflective white or light gray surface along established haulageways and heavy traffic areas such as underground maintenance shops, areas immediately adjacent the bottoms of hoisting shafts, and loading points along conveyors. These locations are generally well illuminated with permanent lighting.

By contrast, rooms where coal is actively being mined are relatively poorly lighted. They will not yet have been rock-dusted and the freshly exposed black surfaces provide no practical light reflectivity. Illumination is provided only by miners' cap lamps and one or more high intensity headlight-type lamps on each mobile mining machine. In the case of shuttle cars, which operate in both directions, there will be one or more headlights on each end. Even where such high intensity lamps are directed toward the face or toward the direction of movement of the machine, lighting is far from uniform. The operator of a continuous mining machine, or loading machine, will have enough light brilliantly illuminating the mine face to keep his machine working efficiently, but the rear boom just behind him is in relative darkness making it difficult for him to see a person immediately behind or to the side. Inasmuch as these face-working machines have conveyor discharge booms which are tiltable up and down, and swingable from side to side, there have been numerous accidents involving persons unseen by the machine operators being struck by the discharge booms and pressed against another machine or one of the side walls. Much too often, these accidents are fatal or are seriously incapacitating.

Mining Industry records show that almost all serious and fatal accidents in working places occur while self-propelled equipment is operated in them.

Pursuant to authority under the Federal Coal Mine Health and Safety Act of 1969, the Secretary of the Interior has promulgated new illumination standards for underground coal mines which, among other things specify that the entire area surrounding self-propelled mining equipment for a minimum distance of five feet be illuminated with a surface brightness of at least 0.06 footlamberts.

To provide this level of illumination, something more efficient than conventional incandescent lamps must be used. Attempts have been made to develop fluorescent lighting which is permissible for use in potentially explosive atmospheres such as coal mines, and which could provide the high level of illumination required by the new standards, but none of these have been entirely satisfactory.

One problem is that the lamps are difficult to install, involving making wiring connections to terminals at locations inside the lamp housing which are not easily accessible.

Another problem is keeping the surface temperature of the lamps, including all metal and light-transmitting components below the limits specified by Federal regulations for explosive atmospheres. Although bulbs for fluorescent lamps generally are regarded as cool to the touch, they actually have two extremely hot regions, at the cathodes adjacent the ends, where the luminous envelope locally can reach 320° to 350° F. Federal regulations for mine lighting prohibit surface temperatures exceeding the ambient by more than 180° F. This means that in coal mines where the ambient air temperature is 60° F. no part of the lamp surface in contact with the atmosphere can exceed 240° F., for that specific ambient temperature.

The temperature of the light-transmitting (polycarbonate or glass) housing at the hot regions of the bulb readily exceeds the permissible limit unless the hot regions of the bulb are shielded off. This, of course, is objectionable because it blocks some of the light, reducing the efficiency of the lamp.

Still another problem is the great difference in thermal expansion coefficients of polycarbonate tubing, commonly used for the light-transmitting housing, and steel and brass, commonly used for the other parts of the lamp. A typical polycarbonate composition and typical steel and brass compositions have thermal expansion coefficients as follows:

Polycarbonate—$6.6\times10^{-5}$in./in./deg.C.

Brass—$1.9\times10^{-5}$in./in./deg.C.

Steel—$1.05\times10^{-5}$in./in./deg.C.

Thus, polycarbonate expands and contracts roughly 3½ times as fast as brass, and 6 times as fast as steel, with changing temperatures. This poses a serious problem during heating and cooling cycles at common interfaces between polycarbonate and either of the two metals. Differential expansion and contraction can crack the polycarbonate material and make the lamp hazardous in explosive atmospheres.

SUMMARY OF THE INVENTION

It is a general object of the present invention to provide a lamp which is permissible for use in explosive atmospheres such as coal mines and which will provide the high illumination required to meet or exceed minimum Federal requirements.

An object of the invention is to provide a lamp which can be installed, wired and repaired easily and quickly in poorly accessible and poorly lighted locations. Specifically, there is a socket and terminal cartridge assembly which is physically removable from the lamp so the power input cable conductors can be wired to the terminals at a convenient location separated from the lamp.

Another object is to provide a fluorescent lamp in which the surface temperature when operating is well below the required maximum Federal temperature limits. Specifically, heat-conducting metal bushings are provided at the ends of the light-transmitting housing which encloses the fluorescent bulb. These metal bushings are located near the luminous heated regions of the bulb so they act as heat conductors and heat sinks for the end portions of the light-transmitting housing. Heat radiated into that housing from the hot regions of the bulb is therefore conducted away through the metal bushings into the metal end housings where is is readily dissipated to the ambient atmosphere.

Another object is to provide a flexible adhesive interface between the ends of the non-metallic light-transmitting housing and the metal bushings, to compensate for their different thermal expansion coefficients.

Other objects and advantages will be apparent from the following description taken in connection with the accompanying drawings in which:

FIG. 9 is a wiring diagram for the lamp shown in FIG. 1;

FIG. 10 is a wiring diagram for a pair of the lamps shown in FIG. 1, connected in parallel and using a common two-lamp ballast;

FIG. 11 is a wiring diagram for the modified form of invention shown in solid lines in FIG. 7; and FIG. 12 is a wiring diagram for the modified form of invention shown in broken lines in FIG. 7.

Like parts are referred to by like reference characters throughout the figures of the drawings.

DESCRIPTION OF THE PREFERRED EMBODIMENTS

Figure 1:
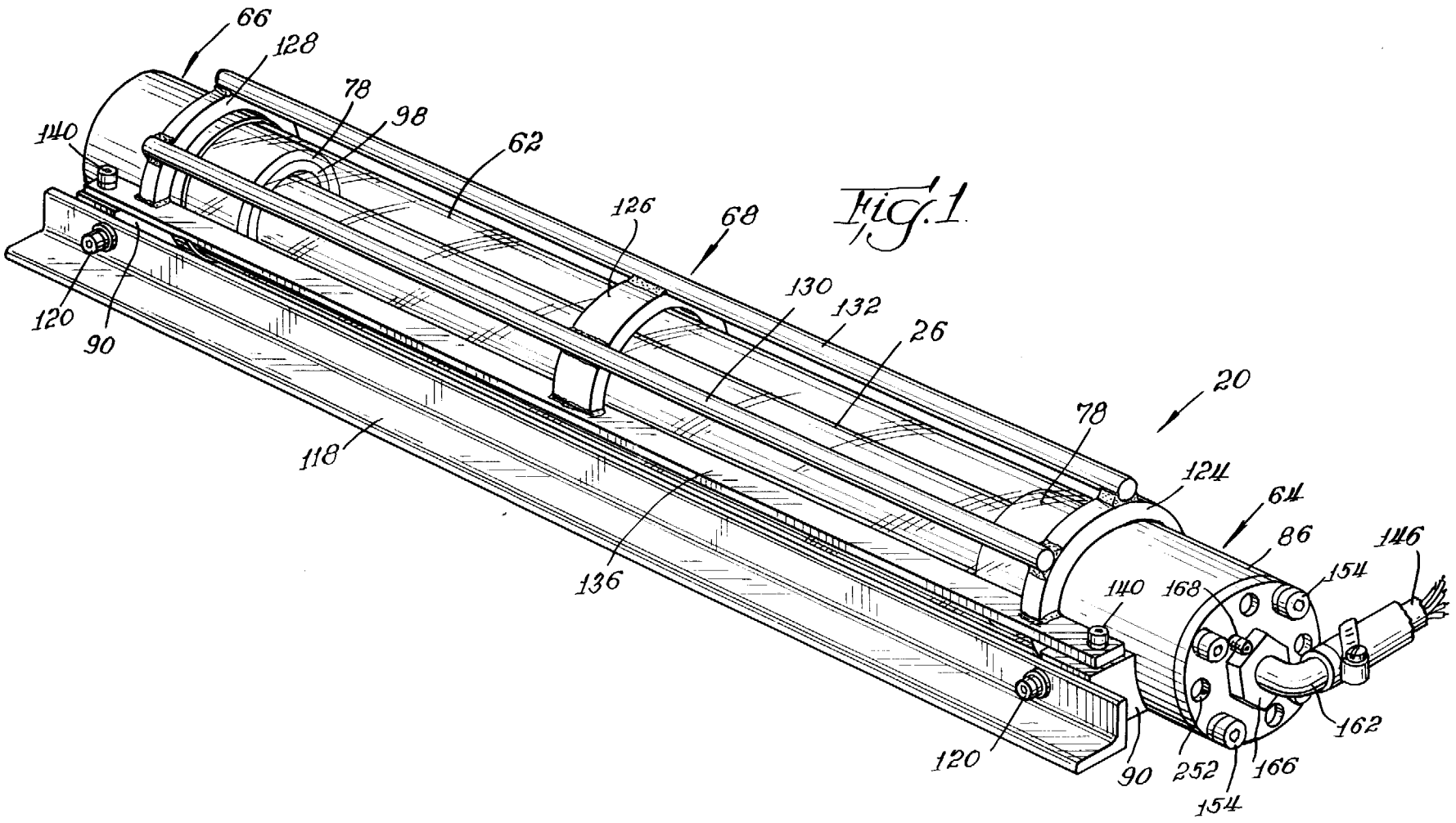
FIG. 1 is a perspective view of a fluorescent lamp illustrating one version of a preferred embodiment of the present invention.
Figure 2:
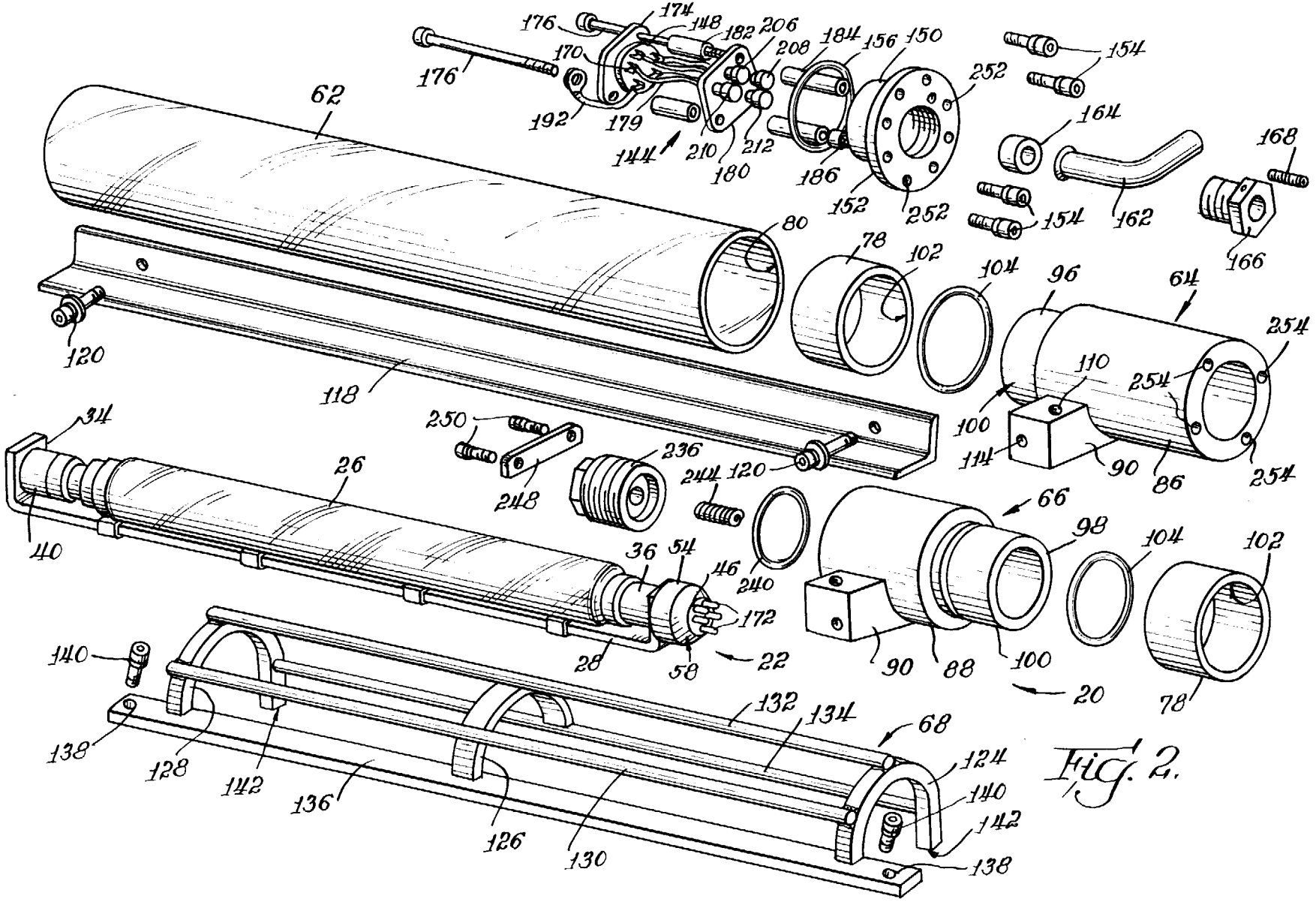
FIG. 2 is an exploded perspective view of the parts of the lamp shown in FIG. 1.

Referring first to the embodiments shown in FIGS. 1–6, 8 and 9, the lamp generally designated 20 comprises an elongated lighting assembly 22 (best shown in FIG. 3) and an external guard assembly 24.

The lighting assembly 22 includes an elongated fluorescent bulb 26 and a U-shaped grounding bracket 28. The bulb is of the directional type, having an internal white reflector (not shown) on part of the inner surface to provide built-in light control. The unreflectorized portion is called the "window". As will be described, the entire lighting assembly can be turned to point the window in a desired direction. The bracket 28 comprises an elongated, bifurcated bar 30 having a center slot 32 serving as a pocket for wiring, and a pair of upturned end portions 34,34. A standard stationary socket 36 is mounted by screws 38, 38 on the end portion 34 at the head end of the lamp, and a standard spring-loaded socket 40 is mounted by screws 42 on the end portion 34 at the tail end of the lamp. The particular bulb 26 is of the super high output (SHO) type, using recessed double pin contacts which the sockets 36 and 40 are designed to fit. A 5-pin plug 46 is spaced from the end portion 34 at the head end of the lamp by a tubular spacer 48 and held in place by a screw 50 threadedly engaged with a tapped opening 52 in the bracket. An annular alignment member 54 has a central opening 56 assembled by a press fit onto the exterior cylindrical surface of the plug 46. It has a conical leading end surface 58 which helps center the lighting assembly 22 when it or a component such as the bulb is replaced. A centering screw 60 is threadedly engaged with the end portion 34 at the tail end of the lamp, and is substantially coaxial with the bulb.

The external guard assembly 24 includes a tubular light-transmitting housing 62, a head end housing 64, a tail end housing 66, and an optional cage 68. Where the housing 62 is clear a thin nylon diffuser sleeve 63 (FIGS. 4 and 4A) may be interposed between the bulb 26 and the housing 62 to reduce glare. If the housing 62 is translucent, the sleeve need not be used.

One of the best materials presently available for the light-transmitting housing 62 is polycarbonate plastic because it has a very high impact strength, it is readily available in water-clear, colored, and a variety of translucent formulations, it has high dimensional stability over a wide temperature range, good electrical properties, and is self-extinguishing. In the United States, base resins for polycarbonate plastics are produced by General Electric Company under the trademark "Lexan" and by Mobay Chemical Co. under the trademark "Merlon". Alternatively, high-impact, shock resistant glass is being developed and may be soon available for this service. The light-transmitting housing 62 may be clear material used with a diffuser sleeve 63, or it may be an equivalent translucent material or combination of materials such as glass or other plastics, with or without a diffuser.

It is the nature of fluorescent bulbs to operate with two localized hot regions 70 and 72 because cathodes 74 and 76 immediately inside these regions are incandescent when the bulb is lighted. The cathodes are usually made of coiled tungsten, like an ordinary incandescent lamp filament except they are filled with alkaline earth oxides. When held at incandescence, they freely emit electrons required for the lamp current. Typically, the bulb surface temperatures at these hot regions, 70, 72 are in the neighborhood of 340° F. to 360° F. This heat, transmitted directly to the light-transmitting housing 62 by radiation can easily raise the external temperature of the tubing above the maximum limit permitted by mine regulations, which, as stated above, is 180 degrees above the ambient, unless special precautions are taken to draw the heat away, which is an important aspect of this invention. As will be explained, heat conductive brass bushings 78, 78 at the ends of the light-transmitting housing 62 limit the build-up of temperature on the surface of the transparent housing by diverting heat into the end housings 64 and 66 from which it is dissipated to the atmosphere.

While polycarbonate is in many ways an ideal material for the light-transmitting housing, its thermal expansion coeffiecient is approximately 3½ times that of the brass in bushings 78, 78. This means that when the lamp is turned on, the heat causes the polycarbonate to expand more, and faster, than the brass; and, when the lamp is turned off, cooling causes the polycarbonate to contract more, and faster, than the brass.

Figure 8:
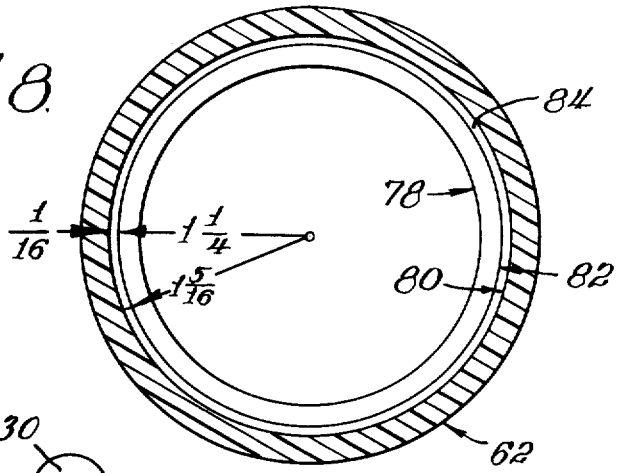
FIG. 8 is a vertical cross-sectional view of FIG. 4 taken along the line 8—8.

This difference in thermal expansion and contraction is compensated for in the present invention by providing ample clearance between the polycarbonate and brass, and by employing a suitable flexible, heat-resistant cement in that clearance. The diameter of the inside wall surface 80 of the light-transmitting polycarbonate housing 62 should be at least 5% greater than the diameter of the mating outside wall 82 of the corresponding brass bushing 78. One specific example which has been used successfully is shown in FIG. 8 where the outside wall 82 of the brass bushing has a 1¼" radius, and the corresponding inside wall 80 of the polycarbonate housing 62 has a 1 5/16" radius. This leaves a clearance 84 of 1/16". That clearance is filled with epoxy cement, providing a joint which is sufficiently heat-resistant and flexible to remain sealed through repeated heating and cooling cycles. This combination of flexible cement or adhesive within the ample clearance space compensates for the differential thermal expansion and contraction characteristics of the two materials, preventing the joint from expanding to the extent that it opens up when heated, and preventing the polycarbonate housing from cracking if it cools faster than the brass bushing.

The head and tail end housings 64 and 66 respectively are generally similar in structure and function although their physical dimensions are not the same in the embodiments illustrated. They have cylindrical bodies 86 and 88 mounted as by welding onto identical semicircular saddles 90, 90, the bodies having through-bores 92, 94 and inwardly extending sleeves 96 and 98 encircling the ends of the lighting assembly 22. The sleeves have first cylindrical bearing surfaces 100 telescopically assembled within second cylindrical bearing surfaces 102 on the bushings, these first and second bearing surfaces being in contiguous, lapping heat-conducting relationship with one another so that heat entering the brass bearings from the polycarbonate tubing is readily conducted to the end housings 64 and 66. Each bearing surface 100 has a groove with an O-ring 104. This seals against the entry of moisture and dust.

Figure 5:
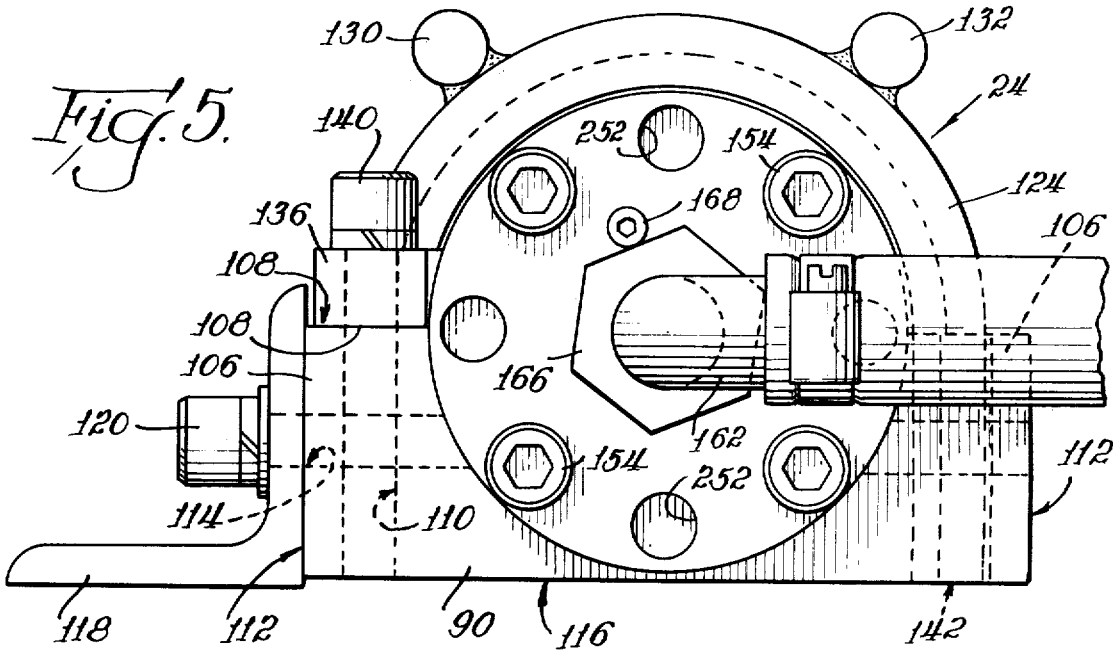
FIG. 5 is a head end view of the lamp as seen from the left end of FIG. 4.
Figure 6:
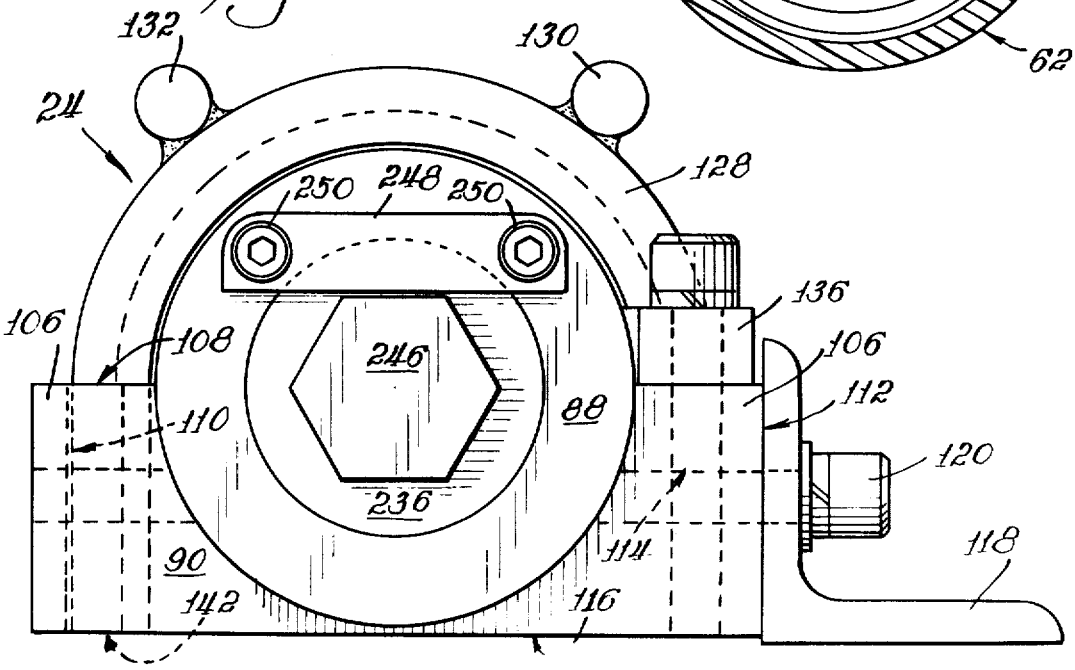
FIG. 6 is a tail end view of the lamp as seen from the right end of FIG. 4.

As best shown in FIGS. 5 and 6, each mounting saddle 90 has a pair of upstanding arms 106 which reach up to the middle of the associated end housing 64 or 66. Each arm 106 has a flat, horizontal seat 108 with a vertical tapped bolt hole 110. Each arm also has a flat, vertical seat 112 with a horizontal tapped bolt hole 114. Stated differently, there are two horizontal seats 108, 108, with bolt holes 110, and two vertical seats 112, 112 with bolt holes 114, on *each* side of the lamp. The two mounting saddles 90 have flat, coplaner bottom base surfaces 116 for supporting the lamp assembly on a flat base member which may be on the mine roof, on one of the ribs, or on the frame of a mining machine.

While the term "vertical" and "horizontal" are used here for convenience in referring to the disposition of parts in the drawings, it will be understood that these terms should not be limiting because the lamp assembly may be mounted in any other way as desired.

The head and tail end housings 64 and 66 are connected together forming a rigid assembly which is independent of the light-transmitting housing 62 (and therefore do not transmit any stress to it) by a tie bar 118 attached to the mounting saddle seats 112 on one side of the lamp assembly by bolts 120 screwed into tapped holes 114. The tie bar may then be attached as by welding or bolts (not shown) to any suitable mounting base. Alternatively, separate mounting feet 122 may be used in which case the mounting base itself would, in effect, act as a spacer connector for the end housings.

In certain mining operations, such as conventional room and pillar coal mining, an additional outer guard assembly is required to protect the light-transmitting housing 62. This is provided here by the cage 68. As illustrated, it has three steel hoops 124, 126 and 128; steel rods 130 and 132 welded across the tops of the three hoops, and a third steel rod 134 welded between the end hoops 124 and 128; and a mounting bar 136 welded across the ends of all three hoops along one side of the lamp; all forming a strong, structural cage as shown. The mounting bar 136 has a pair of holes 138 adjacent its ends. The cage is fixed to one side of the lamp assembly by positioning the mounting bar across the horizontal seats 108 and connecting bolts 140 through holes 138 into the vertical tapped bolt holes 110. Thus, the cage 68 is cantileverly mounted, one side being fixed to the mounting saddles by the bolts 140, and the other side being free to support the ends of the hoops against the base member on which the lamp is mounted. Each of the end hoops 124, 128 curves about the light-transmitting housing to the side opposite the fixed bar 136 where they terminate in foot surfaces 142 which are coplaner with the bottom base surfaces 116 of the mounting saddles. The foot surfaces 142, thus, are adapted to bear on any flat base member to which the lamp assembly is mounted.

The guard cage 68 is reversible, being optionally mountable with its fixed bar 136 connected to the horizontal seats 108, 108 on one side or the other of the lamp assembly to facilitate installation at a location where accessibility to the wiring connections is limited.

The cage 68 functions primarily as a first line of defense against blows which might crush or break the polycarbonate housing. With respect to holding the end housings 64, 66 rigidly spaced, it functions similarly to the tie bar 118 and the alternate mounting feet 122.

A socket and terminal cartridge assembly 144 is positioned within the head end housing 64 and facilitates making quick wiring connections to a multi-conductor electrical input cable 146.

The cartridge assembly 144 comprises a cylindrical body 150 having a flange 152 connected by bolts 154 to the head end housing 64. There is a groove in the cylindrical outer surface 158 of the body 150, just adjacent the flange 152. An O-ring 156 is seated in that groove and bears against the housing inner cylindrical wall 92 to seal it against the entry of moisture and dust. The cable 146 extends through an opening 160 in the body and is sealed by a conventional gland 161 including a cable guide tube 162, packing 164, and a threaded packing compression bushing 166. The latter has a hex flange with a set screw 168 positioned in a tapped hole at the end of the body 150 to prevent accidental loosening of the gland seal.

Figure 4:
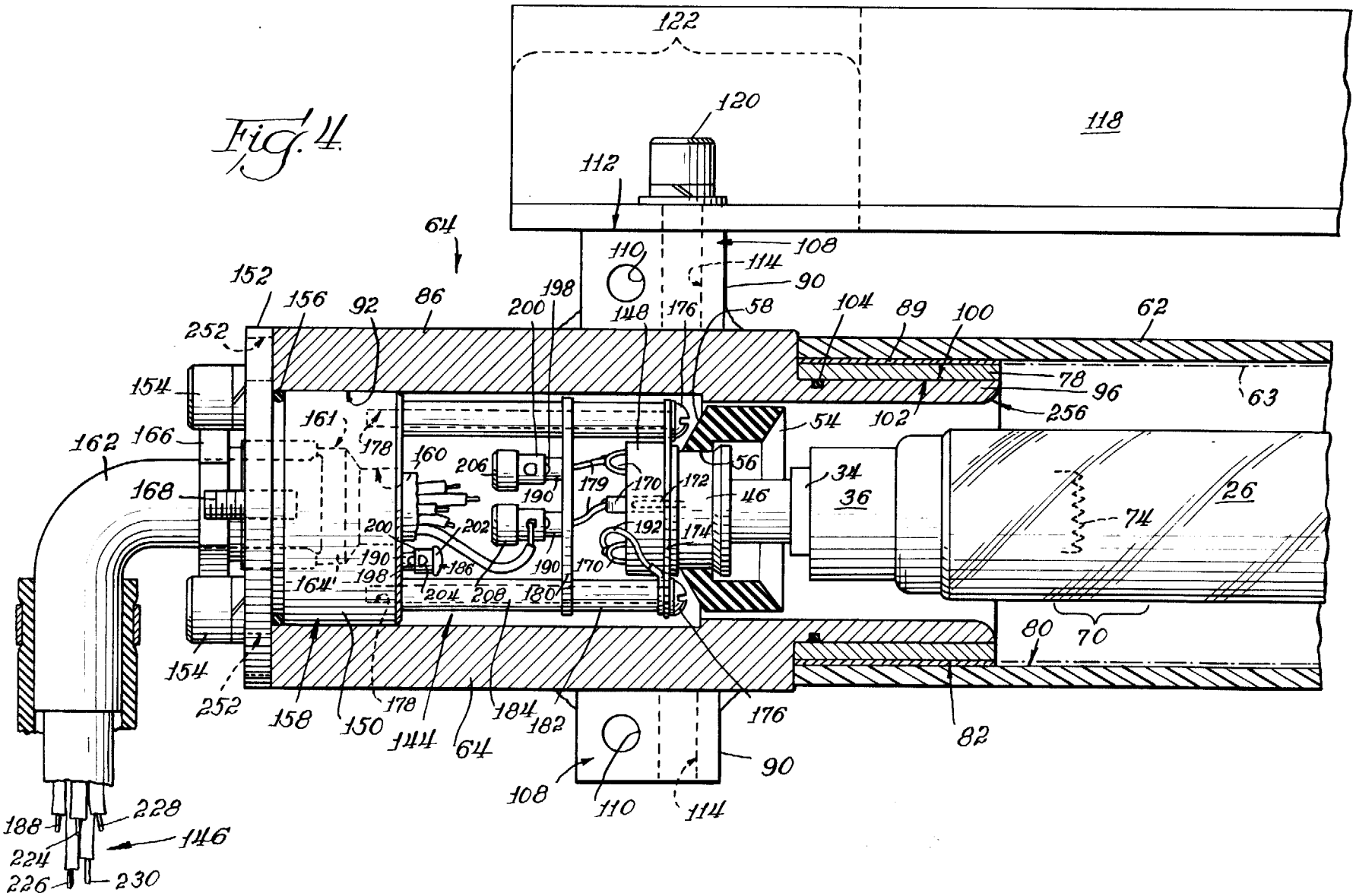
FIGS. 4 and 4A are horizontal, cross-sectional views of head and tail portions of the lamp shown in FIG. 1.

The socket 148 has five socket contacts 170 engagable with five pins 172 extending from the plug 46. The socket 148 has a flange 174 having two apertures mounted on long screws 176, 176. These are threaded into tapped holes 178 in the body 150. An insulating terminal board 180 of material such as "Micarta" formaldehyde plastics is mounted on the screws 176 between insulating spacer tubes 182 and standoff tubes 184. Terminal connectors 186, 206, 208, 210 and 212 provide grounding and active connections between the lamp 20 and a 5-conductor power cable 146 extending from a remote ballast 177. Each of these terminal connectors comprises a fixed lug 190 having a through-hole 198. One lug 190, for the grounding terminal connector 186, is suitably connected to the inner face of metal body 150 as by threading, brazing or soldering. The other four lugs 190, for the active terminal connectors, are fastened to the terminal board 180. A short tube 200 with an insulating end cap 202 is telescopically slidably mounted over each lug 190. Each tube 200 is spring-biased outwardly from its respective lug 190, by internal spring means not shown, and has diametrically opposed holes 204. The holes 204 and 198 can be readily aligned by pressing cap 202 to move the tube 200 inwardly over the lug 190. The bared ends of cable conductors 224, 226, 228 and 230 then can be connected quickly and effectively into the four terminal connectors on the terminal board 180; likewise, grounding conductor 188 can be connected easily to the grounding connector 186. As best shown in FIGS. 4 and 9, active conductors 224 and 226 are connected via socket 148 and plug 46 into head end cathode 74; and active conductors 228 and 230 are connected via the socket and plug, and conductors 228' and 230' extending along slot 32, to tail end cathode 76.

As shown in the circuit diagram of FIG. 9, the lamp 20 is connected to a power source through the external ballast 177. 110-volt A.C. power is brought to the ballast through a 3-wire cable 216 having active conductors 218 and 220 and a grounding conductor 222. A ground connection is completed from conductor 222 to the external metal lamp components as follows: via the ballast 177, conductor 188, terminal connector 186, cartridge body 150, head end housing 64, one of the screws 176, conductor 192, socket 148, plug 46, grounding bracket 28, spring 60, and tail end housing 66.

The tail end housing 66 has an inspection cap 236 threadedly engaged with the large tapped opening 238 in the tail end body 88. A moisture-proof seal is provided by O-ring 240 in a groove formed in the through-bore 94 at the inner end of the tapped opening 238. The inner, leading edge of the cap 236 has a 45-degree beveled corner 242 which presses the O-ring into the groove to provide an effective seal. As previously described, the centering screw 60 is coaxial with the bulb. A short compression spring 244 is seated within the central opening 246 in the inspection cap, and encircles the screw 60, being compressibly interposed between the tail end 34 of the grounding bracket and the inspection cap.

The screw 60 and spring 244 have several functions: (1)They hold the tail end portion of the lighting assembly centered and cushion it against shock. (2) the spring presses the plug 46 at the head end firmly into the socket 148. (3) the spring provides a grounding connection between the grounding bracket 28 and the tail end housing 66. And, (4) the screw provides a convenient grip for removing and replacing the lighting assembly 22 through the tapped opening 238 and passageway 94.

The cap 236 has a hexagonal external boss 246 with six flats, one of which is engaged by a strap 248 fastened to the end of the body 88 by bolts 250, 250.

One of the advantages of the removable socket and terminal cartridge assembly is that it may be removed from the rest of the lamp assembly for connecting the ends of the wire conductors of cable 146. By this arrangement, all the conductors of cable 146 can be wired into the socket and termianl cartridge assembly, and the cartridge bolted into place, in less than three minutes. The ability to remove the cartridge for this purpose greatly facilitates hook-up.

The cartridge 144 and the lighting assembly 22 are interconnected solely through the plug 46 and socket 148. The entire lighting assembly therefore may be rotatably adjusted to point the window of the bulb in a desired direction, merely by adjusting the rotated position of the cartridge 144. As best shown in FIGS. 4 and 5, four bolts 154 extend through bolt holes 252 of flange 152 into four tapped holes 254 in the head end body 86. While there are four bolts 154 and tapped openings therefor fixed at 90° spacings, there are eight holes 252 in the flange at 45° spacings. Thus, by removing bolts 154, the cartridge 144, together with the lighting assembly 22, can be rotated 45° in either direction from the position shown on the drawings, and then held in the new rotated position by using the set of bolt holes 252 which are not used in FIG. 5. This enables the bulb 26 to be directed straight outwardly from a mounting base, or 45° to the left or right or up or down, depending on the orientation of the lamp.

The entire lighting assembly 22 can be removed and replaced quickly and easily simply by removing the tail end cap or closure 236, grasping the centering screw 60 by hand or by a threaded socket tool, removing the old lighting assembly, inserting a new one, and replacing the closure. The beveled or conical leading end surface 58 of the alignment member 54, and the curved or beveled inner end surface 256 of head end sleeve 96 facilitates centering and inserting the lighting assembly.

Figure 7:
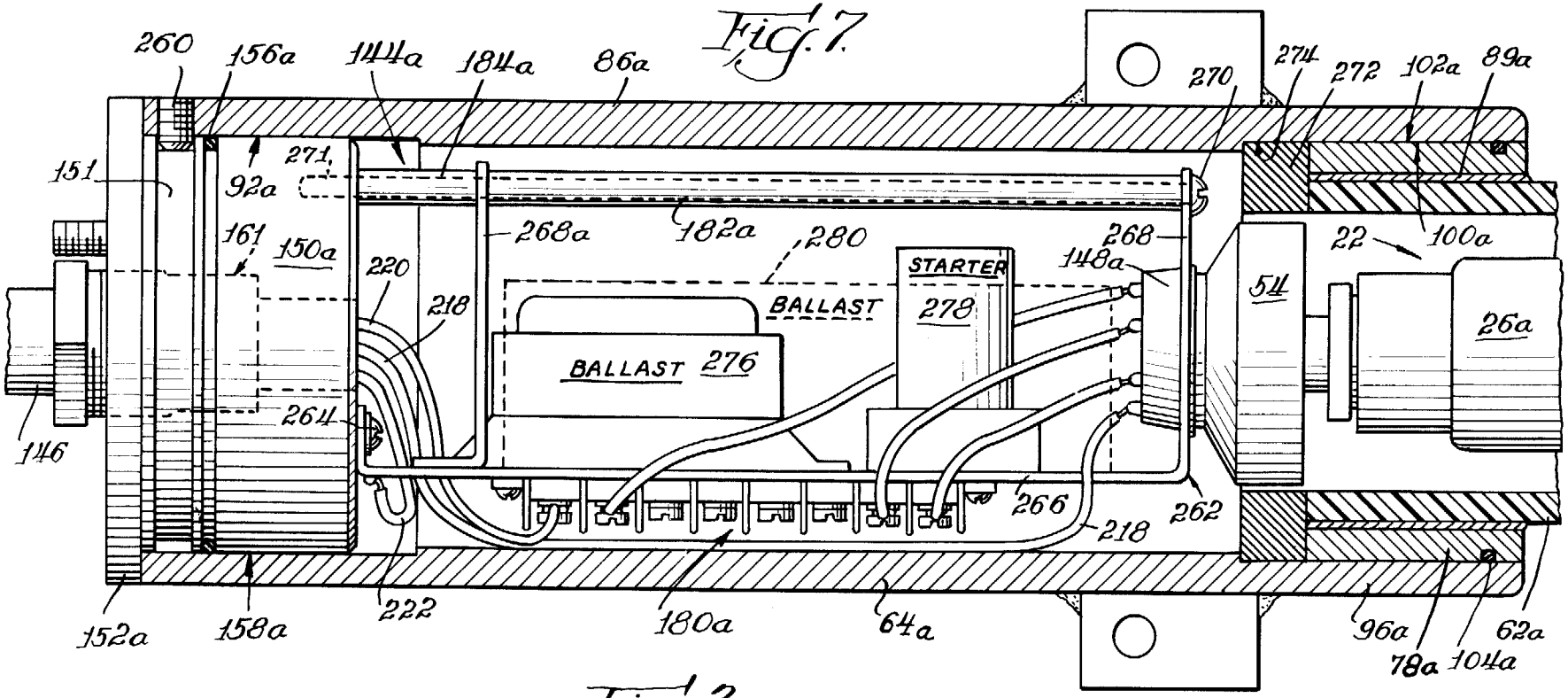
FIG. 7 is a view similar to FIG. 4 showing in solid lines and broken lines respectively, modified forms of the invention.
Figure 3:
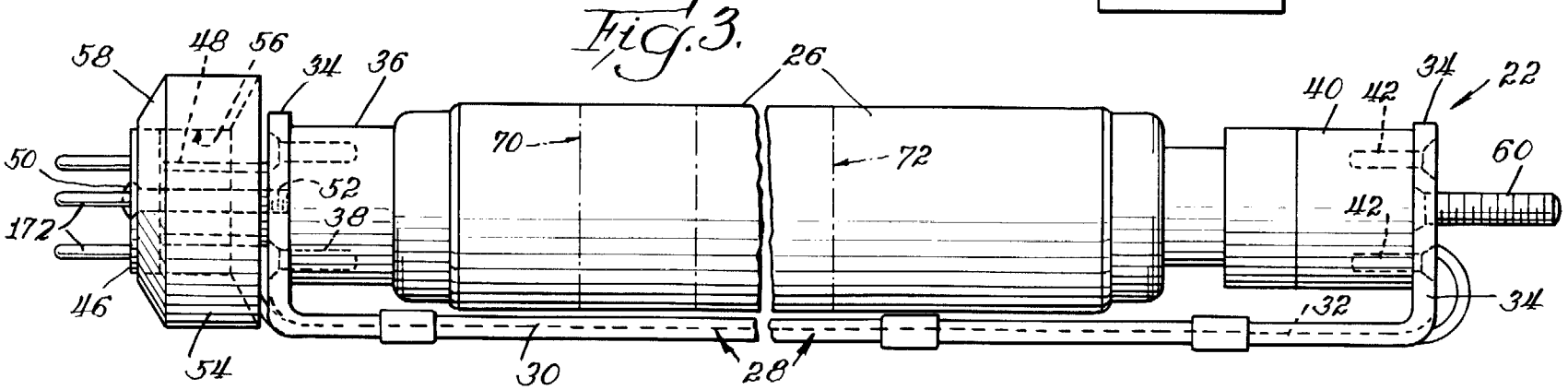
FIG. 3 is an assembly view of the lighting assembly shown in the previous figures.

Alternate embodiments of the invention are illustrated in FIG. 7 by means of solid and broken lines respectively. These are similar to the embodiment shown in FIG. 4 except for details of the socket and terminal cartridge assembly and its rotational adjustment, and a reversal in the relationship between the light-transmitting housing and the heat conductive bushings at its ends. The embodiments illustrated in FIG. 7 will now be described using the same reference characters where the parts are the same as in FIG. 4, and the same reference characters followed by the letter "a" where they are similar but not identical.

In FIG. 7, the cartridge assembly **144*a* has a cylindrical body 150*a* with a smooth flange 152*a*. Contrasted with flange 152, flange 152*a* has no bolt holes. An O-ring 156*a* is seated in a groove in the cylindrical outer surface 158*a* and seals against the inner cylindrical surface of through-bore 92*a*. A relatively wide groove 151 extends around the body in surface 158*a* and it has a flat bottom engagable by a series of set screws 260 extending through tapped holes positioned around the head end body 86*a*. By loosening the set screws and turning flange 152*a*, cartridge assembly 144*a* and the lighting assembly 22** are adjustable to a desired rotated position within the lamp.

A bracket 262 is mounted by screws 264 to the inner face of the cartridge body **150*a*. It has a floor portion 266 extending lengthwise of the lamp, and transverse portions 268 and 268*a*. The socket 148*a* is mounted on end portion 268**.

A terminal block **180*a* is mounted on the underside of the bracket floor portion 266. Conductors 218, 220 and 222 extend through gland 161 from external cable 146 into the terminal block 180*a*. Overall wiring diagrams for the embodiments shown in FIG. 7 are in FIGS. 11 and 12. The ends of transverse portions 268 and 268*a* are held by a long screw 270** threaded into a tapped opening 271 in the cylindrical body 150a. Transverse portion 268a is spaced along that screw by means of insulating spacer and stand-off tubes 182a and 184a.

As shown in FIG. 7, a heat conductive steel or brass collar 272 is seated in bore 274 in the head end cylindrical body 86a. This centers the alignment member 54 during assembly, and provides a convenient backing for the light-transmitting polycarbonate housing 62a and the brass bushing 78a. Note that in this embodiment the light-transmitting housing 62a is somewhat smaller in diameter than the previously described light-transmitting housing 62, and brass bushing 78a is located externally of it. The brass bushing is cemented to the polycarbonate housing by epoxy adhesive 89a leaving a minimum 5% diametrical clearance between these parts as described in connection with FIG. 8. This provides a more compact lamp inasmuch as it utilizes a smaller diameter light-transmitting housing. The head end body 86a has an inwardly extending sleeve 96a which is the reverse of the previously described sleeve 96 in that it has a first cylindrical bearing surface 100a on the interior thereof and it is in contiguous, lapping heat-conductive telescopic relationship with a second bearing surface 102a on the outer portion of the bushing 78a. An O-ring 104a is seated in a groove in bearing surface 102a and bears against the sleeve surface 100a to provide a moisture and dust proof seal.

While the bearing arrangement for the tail end housing for the FIG. 7 embodiment is not specifically shown, it will be substantially identical to the head end arrangement so a detailed description will not be given.

The description of FIG. 7 so far covers the structure which is common to both embodiments shown in that figure. These will now be described.

FIG. 7 shows the invention as applied to a standard preheat fluorescent self-contained lamp in which a light duty ballast 276 and a starter 278 are mounted on the cartridge bracket 262 and are removable and replaceable as part of the socket and cartridge assembly 144a. The ballast 276 and starter 278 are connected into terminal block 180a (by wiring connections not shown). Typically, this is for a small, individual lamp of 20 watts or less. A representative circuit diagram for a single lamp is shown in FIG. 11.

Alternatively, FIG. 7 shows, in broken lines, a larger ballast 280 which could be substituted for the smaller ballast 276 and starter 278, in a higher wattage self-contained lamp. One example would be for a medium output fluorescent bulb 26a of 30 to 40 watts where the ballast 280 would be connected into terminal block 180a by wiring connections not shown. Another example would be for a high output (HO) or a super high output (SHO) bulb 26a of 65 watts or more where the ballast 280 would have a suitable high power rating to match the bulb and of sufficiently compact dimensions to fit within the head end housing 64a as shown. A representative circuit diagram for such a single bulb lamp of medium, high or super high output is shown in FIG. 12.

As stated, FIG. 9 is a circuit diagram of a lamp using an external ballast, this being for super high output (SHO) lamps in the order of 65 watts. FIG. 10 is a circuit diagram for the same super high output type, with two bulbs connected in parallel and using a single two-lamp ballast.

An important part of the invention is use of the heat conductive brass bushings 78 and 78a at the ends of the light-transmitting housings 62 and 62a to keep the external temperatures well below the maximum limits required by Federal regulations.

Referring to FIG. 4/4a when the lamp is operating, the cathodes 74 and 76 heat the immediately adjacent bulb surfaces 70, 72 to a range in the order of 340° to 360° F. Heat radiated from these localized hot regions of the bulb is directed radially outwardly to the adjacent wall of the polycarbonate tubing 62. Heat flows along the tubing, to the brass bushings 78. The bushings act as heat sinks, receiving the heat through the heat conductive epoxy layer, and transmitting it to the sleeves 96 and 98 of the head and tail end housings where it is dissipated to the atmosphere. In practice, where the mine ambient temperature is 60° F., the outside surface temperature of the polycarbonate tubing never exceeds about 210° F., which is well below the limit of 240° F. for that ambient temperature.

Referring to the embodiments in FIG. 7, heat flow is similar to that described above, being from the cathodes at both ends of the bulb to the polycarbonate tubing 62a, and then through the brass bushings 78a to the head and tail end housings for dissipation to the ambient atmosphere.

Figure 4A:
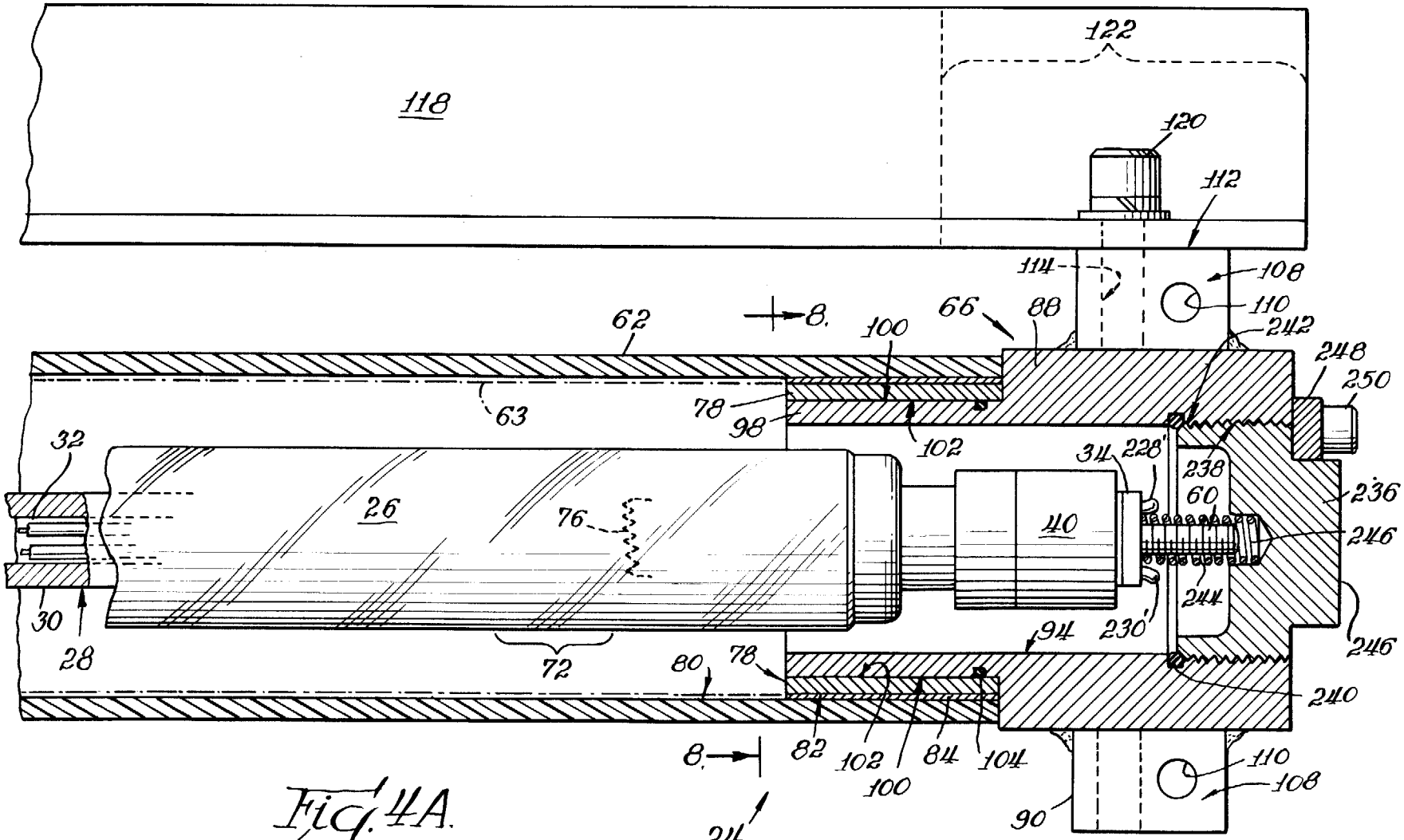

By interconnecting the head and tail end housings 66 by means of the tie bar 118, or the cage 68, or by mounting the alternate feet 122, 122 on a solid base, the light-transmitting housing 62 is completely free of stresses transmitted from other parts of the lamp or means for supporting the lamp. The same is true for the light-transmitting housing 62a shown in the FIG. 7 embodiment. In fact, when installed, the light-transmitting housing may actually be free to rotate about, and have a little end play relative to, the bearing surfaces on the end housing sleeves. By removing stress from the light-transmitting housing, its rating and service life can be improved. As an incidental advantage, in case a portion becomes cloudy or scratched, it may be rotated to an out-of-the-way position. As shown in FIGS. 4 and 4A, the bushings 78, 78 and the interior wall of the tubular housing 62 form a pocket, stabilizing the diffuser sleeve 63 in its operative position.

As described for the socket and terminal cartridge assembly 144, the counterpart assembly 144a shown in FIG. 7 may be removed as a unit from the rest of the lamp assembly for connecting conductors 218, 220 and 222 into the terminal block 180a, as well as for servicing or replacing the starter 278 or the ballast 276 or ballast 280.

The above described embodiments show a small number of possible variations of the invention. Numerous and varied other arrangements can readily be devised in accordance with the principles herein disclosed without departing from the spirit or scope of the invention. For example, the light-transmitting housing 62 or 62a may be high impact strength glass or some equivalent plastics material instead of polycarbonate. A translucent formulation for the tubular housing 62 is made by mixing two Mobay Chemical Co. "Merlon" polycarbonate molding resins, namely 5 parts Resin M50U Clear with one part M40U-3152 White; in this case the diffuser sleeve 63 is not required. And the bushings 78 may be copper, aluminum, carbon or some other equivalent heat conductive material.

The embodiments of the invention in which an exclusive property or privilege is claimed are defined as follows:

1. A lamp permissible for use in explosive atmospheres such as mines comprising:

an elongated lighting assembly and a guard assembly therefor;

said lighting assembly including an elongated bulb characterized by a luminous envelope having hot luminous regions at the end portions thereof;

said guard assembly including a light-transmitting tube enclosing said bulb, and metal end housings at opposite ends of said tube, each metal end housing having integral therewith a continuous cylindrical sleeve completely surrounding an end portion of said lighting assembly, each said sleeve being located adjacent and axially displaced from the corresponding one of said hot luminous regions to enable said hot luminous regions to transmit light directly outwardly therefrom through end portions of said light-transmitting tube;

said sleeves having first cylindrical bearing surfaces, said light-transmitting tube having heat-conductive metal bushings fastened thereto at opposite ends thereof and in heat-conductive relation therewith, said bushings having second cylindrical bearing surfaces assembled in contiguous, lapping, heat-conductive, telescopically slidable relationship with said first bearing surfaces to enable relative thermal expansion and contraction of their associated parts; and said sleeves being located sufficiently closely adjacent said hot luminous regions to act as heat sinks thereby diverting heat from said tube through said metal bushings into the metal end housings to maintain the temperature of the tube at a safe level.

2. A lamp according to claim 1 in which an outer guard cage overlies the light-transmitting tube, said end housings having coplaner base surfaces adapted to be mounted on a flat base member, said guard cage having a cantilever mounting with fixed and free sides in which the fixed side is connected to the end housings on one side only of the lamp, and the free side has foot means terminating in the plane of said base surfaces adapted to bear on said flat base member when the lamp is mounted thereon.

3. A lamp according to claim 2 in which said outer guard cage is reversible, being optionally mountable with its free side on either side of the lamp.

4. A lamp according to claim 1 in which said light-transmitting tube is made of polycarbonate or glass having inside cylindrical surfaces fastened by flexible epoxy cement to outside cylindrical surfaces of said bushings, the diameters of said inside cylindrical surfaces being at least five percent (5%) larger than the diameter of the corresponding outside cylindrical surfaces to prevent cracking of said light-ransmitting tube during heating and cooling cycles incident to illuminating and extinguishing said lamp.

5. A lamp permissible for use in explosive atmospheres such as mines including:

an elongated lighting assembly and a guard assembly therefor;

said lighting assembly including on elongated bulb and plug means at one end having pin means extending therefrom;

said guard assembly comprising a tubular light-transmitting housing enclosing at least said bulb of said lighting assembly, and a heat end housing and a tail end housing at head and tail ends respectively of said lighting assembly;

said end housings having through-bores extending axially therethrough, into which the head end portion and the tail end portion respectively of said lighting assembly extend, each said end housing having removable closure means fastened thereto closing the end of the corresponding through-bore opposite the adjacent end of the lighting assembly;

said closure means on the head end housing having an opening with gland means for an electrical cable adapted to extend from an outside electrical power source to the interior of the head end housing;

a socket and terminal cartridge assembly on the inner face of the head end housing closure means including socket means at the inner end thereof within which the pin means of said plug means is connectible, and a terminal board having terminal means connected to said socket means, said terminal means in turn being connectible to said electrical cable extending through said gland means, said lighting assembly being connected to said cartridge assembly for rotational adjustment therewith; and locking means acting between said head end housing and said socket and terminal cartridge assembly for locking the lighting assembly in a selected rotatably adjusted position;

whereby said socket and terminal cartridge assembly is removable as a unit with the head end housing closure means to facilitate making wiring connections between a cable and said terminal means while separate from the rest of the lamp.

6. A lamp according to claim 5 in which said socket and terminal cartridge assembly includes a ballast connected between said socket means and said terminal means for rotatable adjustment therewith.

* * * * *